US006536820B1

(12) United States Patent
Dean et al.

(10) Patent No.: US 6,536,820 B1
(45) Date of Patent: Mar. 25, 2003

(54) HANDLE ASSEMBLY FOR BULK FLUID CONTAINERS

(75) Inventors: Michael C. Dean, Alpharetta, GA (US); Daniel P. Brown, Palos Park, IL (US); Ross Wilson, Utica, IL (US)

(73) Assignee: Flexible Products Co., Marietta, GA (US)

( * ) Notice: Subject to any disclaimer, the term of this patent is extended or adjusted under 35 U.S.C. 154(b) by 0 days.

(21) Appl. No.: 09/712,534

(22) Filed: Nov. 14, 2000

(51) Int. Cl.[7] ..... B65D 71/00

(52) U.S. Cl. ..... 294/159; 294/15; 294/169; 294/170

(58) Field of Search ..... 294/15, 26, 27.1, 294/31.2, 87.1, 87.2, 93, 99.1, 137, 150, 153, 158, 159, 162–167, 169, 170; 206/139, 150, 162, 164, 427; 220/752, 755, 759, 769

(56) References Cited

U.S. PATENT DOCUMENTS 1,137,909 A * 5/1915 Rusfeldt ..... 294/159 X
1,540,155 A * 6/1925 Wydom et al. ..... 294/170
1,563,000 A * 11/1925 Wajer et al. ..... 294/170 X
1,578,105 A 3/1926 Taylor
2,371,920 A * 3/1945 Trevisan ..... 294/170 X
2,620,955 A 12/1952 Elder
2,782,915 A * 2/1957 Fahringer ..... 294/170 X
3,083,886 A * 4/1963 Fry ..... 294/159
3,251,622 A * 5/1966 Miller ..... 294/159 X
3,262,727 A * 7/1966 Blackaby ..... 294/170
3,330,408 A * 7/1967 Wanderer ..... 294/87.2 X
4,168,025 A * 9/1979 Bantner ..... 294/159
5,259,524 A 11/1993 Eckert
5,344,051 A 9/1994 Brown
5,507,544 A * 4/1996 McQuade et al. ..... 294/170 X

* cited by examiner

*Primary Examiner*—Johnny D. Cherry
(74) *Attorney, Agent, or Firm*—Vedder Price Kaufman & Kammholz

(57) ABSTRACT

A handle assembly for holding together a pair of bulky fluid supply containers, such as liquid foam reaction product containers is provided that has a unique force exerting characteristic. The two containers are encircled by a flexible band capable of tightening, while a wire form member is provided that attaches to the supply container handles. This wire form member may serve as a handle and it has two diverging leg portions with free ends that engage the handles of the supply containers. The leg portions exert an outward force due to their divergence on the supply containers to bias them outwardly against the band.

38 Claims, 9 Drawing Sheets

HANDLE ASSEMBLY FOR BULK FLUID CONTAINERS

BACKGROUND OF THE INVENTION

The present invention relates generally to the transport of bulk fluid containers, and more particularly, to handle assemblies that facilitate the carrying of bulk fluid containers used in fluid dispensing systems.

Polyurethane foams are well known in the art and may be formed either as a single component foam or as the reaction product between two reactive foam components. Both such foams may be used as adhesives or for insulating purposes. In the use of two component foams, each distinct foam component must be maintained in a separate supply container. The supply containers are linked together with supply tubes that interconnect with a dispensing gun to provide a conduit, mixing chamber and dispenser for the foam components and mixed together. These supply containers take the form of relatively bulky tanks about 11 to 12 inches high by about 8 inches in diameter. When used in an application, the supply tanks can be typically carried by a user, one in each hand.

In order to facilitate the transport of these containers, boxes or cartons have been developed to hold the two containers together as a unit in a single package. A handle is formed either as part of the box or as a separate component that is engaged with the carton. Due to the weight of the containers, these cartons had to be made from heavyweight thick and durable cardboard in order to hold the foam component supply tanks.

A number of problems exist with these boxed structures. For example, when a separate handle component is used with the carton, it has a tendency to at least partially disengage during shipping and transport, so that when a user picks up the carton, the handle may come free forcing him to drop the carton, resulting sometimes in sore shins and feet. In wet weather, water may work itself into the walls of the box, weakening the corrugated cardboard from which it is made. With the cardboard weakened by the water, the supply tanks will often break through the carton due to their weight. Accordingly, there exists a need for an improved device for holding the two foam component supply tanks together during operation, storage and transport. The present invention is directed to such a device.

SUMMARY OF THE INVENTION

The present invention is directed to a carrying assembly for use with fluid supply tanks that overcomes the aforementioned disadvantages of the prior art.

It is therefore a general object of the present invention to provide an improved assembly for carrying a pair of fluid supply tanks that is weather-resistant and inexpensive.

It is another object of the present invention to provide a handle assembly for a pair of foam component supply tanks that holds the two supply tanks together as a unit and which can be easily grasped with one hand.

A still further object of the present invention is to provide an assembly that holds two supply containers together in an arrangement that facilitates the storage, carrying and transport of the container the assembly holding the containers together as a unit and including first means for holding the two tanks together at one location thereof and second means for holding the two tanks together at a second location spaced apart from the first location, the second means also serving as a handle so that a user may hold the two tanks together as a unit.

Yet another object of the present invention is to provide a handle that is adopted to engage the flanges of two foam component supply tanks, the handle having a flat gripping portion and at least two free ends depending down from the gripping portion, the free ends each having engagement ends extending outwardly therefrom to engage portions of two supply tanks, the handle further having means for flexibly adjusting to engage the supply containers The present invention accomplishes these objects by way of its unique structure. As exemplified by a first embodiment of the invention, a first holding means, such as a binding strap is provided of sufficient length for wrapping around the two supply tanks. The strap is tightened so as to hold the two tanks together, preferably at or slightly below the midsection of the supply tanks. A second holding means in the form of a holding member is also provided to hold the two supply tanks together, at a second location spaced from the first location. This second holding member is a flexible wire form that includes two free ends that fit into holes formed in collars of the supply tank. The second member not only engages the supply tanks, but also has a horizontal portion that spans the space between the supply tank collars and which has openings that receive a flexible handle member attached thereto.

In a second embodiment of the invention, the second member includes larger leg portions which have a loop formed therein that increases the flexibility of this second member so that it flexes between different orientations adaptable to all sizes of tanks. With this assembly, the need for a carton as a structural package is eliminated, and the task of carrying the supply tanks becomes independent of the carton structure. The bulkiness of the carton is eliminated as are the failures due to moisture. The second member is a wire form member that provides a slight spring bias outwardly, which opposes the inward force which the first member applies to the supply tanks.

In another embodiment of the invention, the second holding member has a multi-part construction that includes a handle and two leg members. The leg members engage the supply tanks and extend upwardly and outwardly therefrom at a preselected angle. The leg members mate with a handle member that has a pair of free ends that rotatably mate with corresponding free ends of the leg members. In this manner, the handle member may be rotated sideways to nest adjacent the supply tanks so as to facilitate packing, storage and stacking of the packaged supply tanks.

These and other objects, features and advantages of the present invention will be clearly understood through consideration of the following detailed description.

BRIEF DESCRIPTION OF THE DRAWINGS

In the course of this description, reference will be made to the attached drawings in which.

DETAILED DESCRIPTION OF THE PREFERRED EMBODIMENTS

Figure 1:
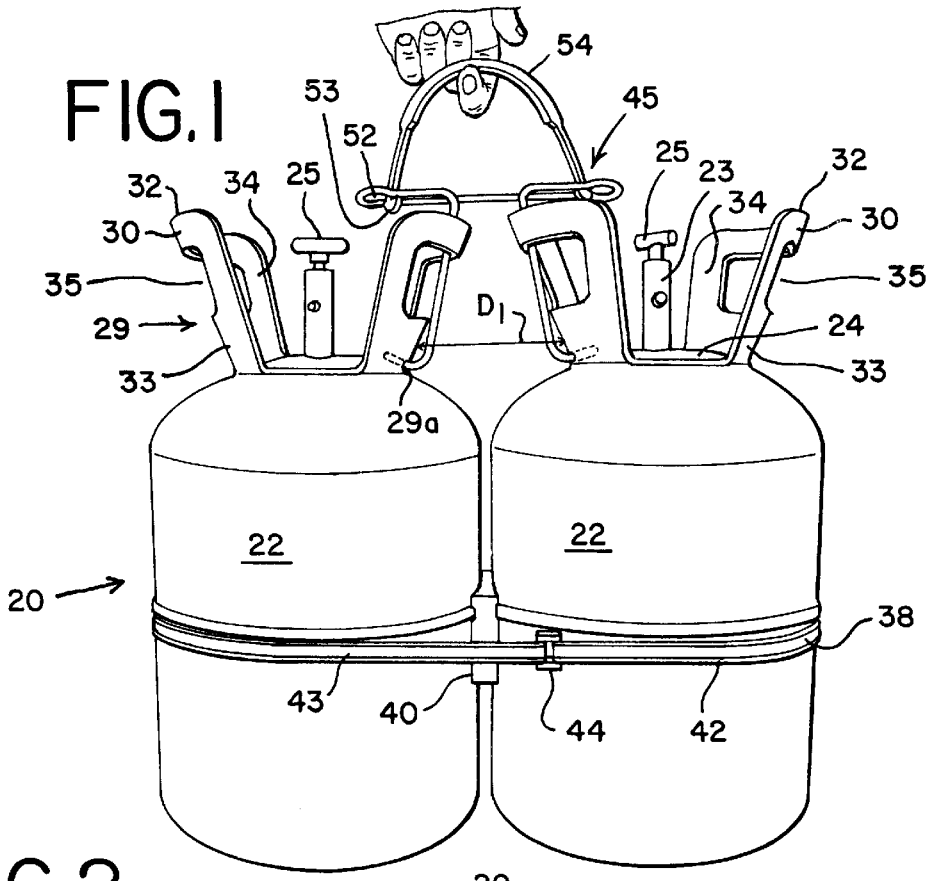
FIG. 1 is an elevational view of a first embodiment of the present invention installed in place upon a pair of foam component supply tanks to form a supply tank assembly.

FIG. 1 illustrates a handle assembly 20 constructed in accordance with the principles of the present invention and utilized in association with a pair of fluid supply containers 22. Each of the fluid supply containers 22 is formed from metal and is used to hold a supply of a dispensable fluid which typically will be a reactive foam component. The two foam components are maintained in the containers 22 under pressure and are selectively dispensed from the containers 22 through valve assemblies 23 that project from the top exterior surface 24 of the containers 22. Each valve assembly 23 has a manually operated valve member 25 which may be operated by a user so that the fluids travel through dispensing hoses 26 (FIG. 11) that lead to a dispensing gun 27 similar to the type illustrated in U.S. Pat. No. 5,344,051, owned by the assignee of the present invention.

Figure 3:
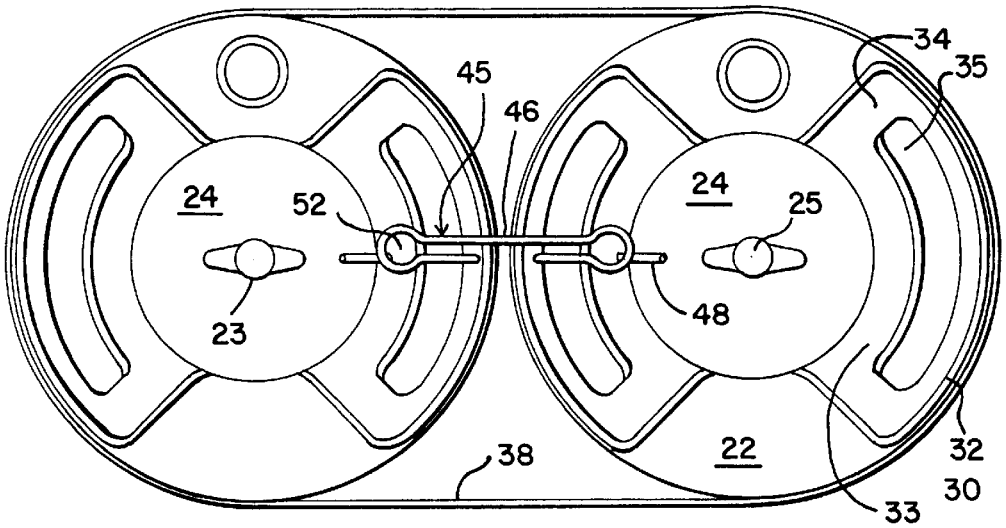
FIG. 3 is a top plan view of the assembly of FIG. 1.

The supply containers 22 commonly have handle, or collar portions, 29 illustrated as upstanding flanges 30. As seen in FIGS. 1 and 3, these flanges are curved and are seen to include top and bottom portions 32, 33 and side portions 34 that encompass an opening 35. The handle portions 29 may be formed from a single sheet of metal, such as by stamping and then subsequently welded to the body portion of the containers 22.

Previously, both of the supply containers 22 were either carried individually or held within a heavyweight corrugated carton or cardboard box. One problem complained of with these structures was that in inclement weather, the walls of the carton would become thoroughly soaked and weakened to the point that the supply containers 22 would break through the walls of the carton which was troublesome. The present invention provides an improved handle assembly that overcomes these problems and which is strong, lightweight and easy to manufacture.

Figure 2:
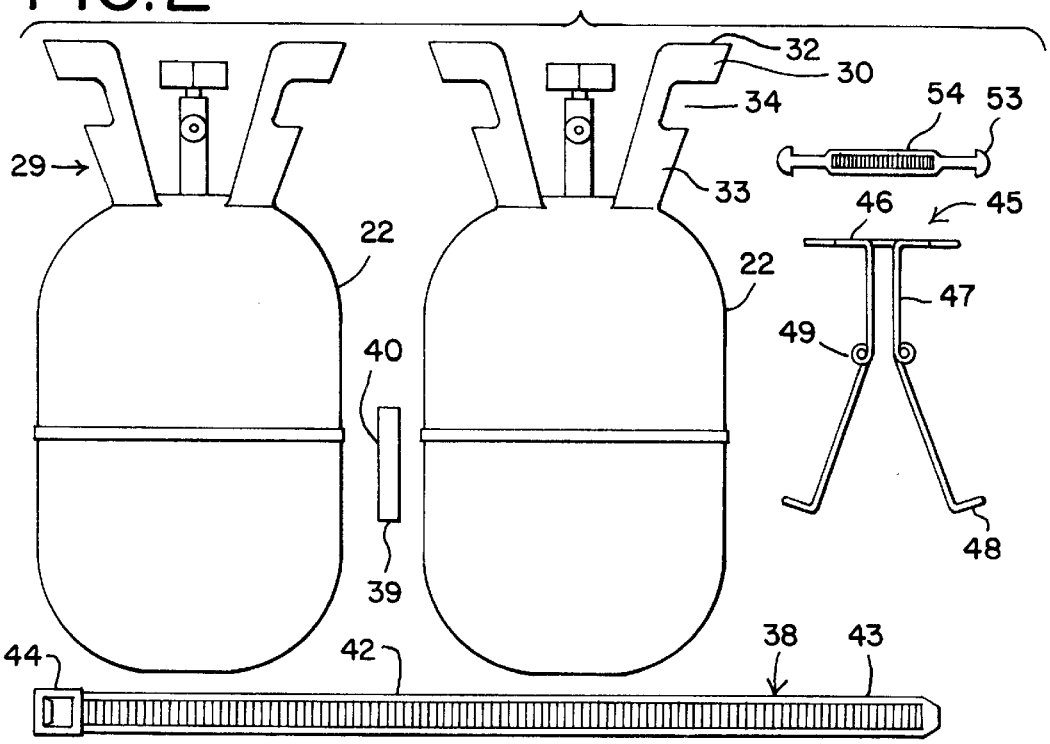
FIG. 2 is an exploded view of the supply tank assembly of FIG. 1.

In one aspect, the present invention includes the entire structure of the handle assembly and the supply containers 22. FIG. 1 illustrates the overall assembly 20 in place upon two supply containers 22, while FIG. 2 illustrates the assembly 20 and supply containers 22 in an exploded view to show the constituent parts. Each of the containers 22 shown is generally cylindrical and as such, the assembly 20 first includes a band 38 that extends around, or encompasses, the two containers 22 and holds them together as a unit. A cushion, in the form of a pad 39, preferably one with a self-adhesive coating 40 on one side thereof may be provided to prevent the two containers 22 from banging into each other or bearing against each other. The band 38 is illustrated as a plastic cable tie 42 having an elongated tail portion 43 and a head portion 44 at one end thereof. As is known in the art, the tail portion 43 is inserted into the head portion 44 and down therethrough to apply a restraining force to the containers 22 and placing the tie 42 under tension. Alternatively, the band 38 may include a steel strap and locking member in place of the cable tie illustrated, as well as other structures. The band 38 serves to maintain the body portions of the containers 22 together. Other straps, such as a plastic welded strap may be utilized as well.

Figure 4:
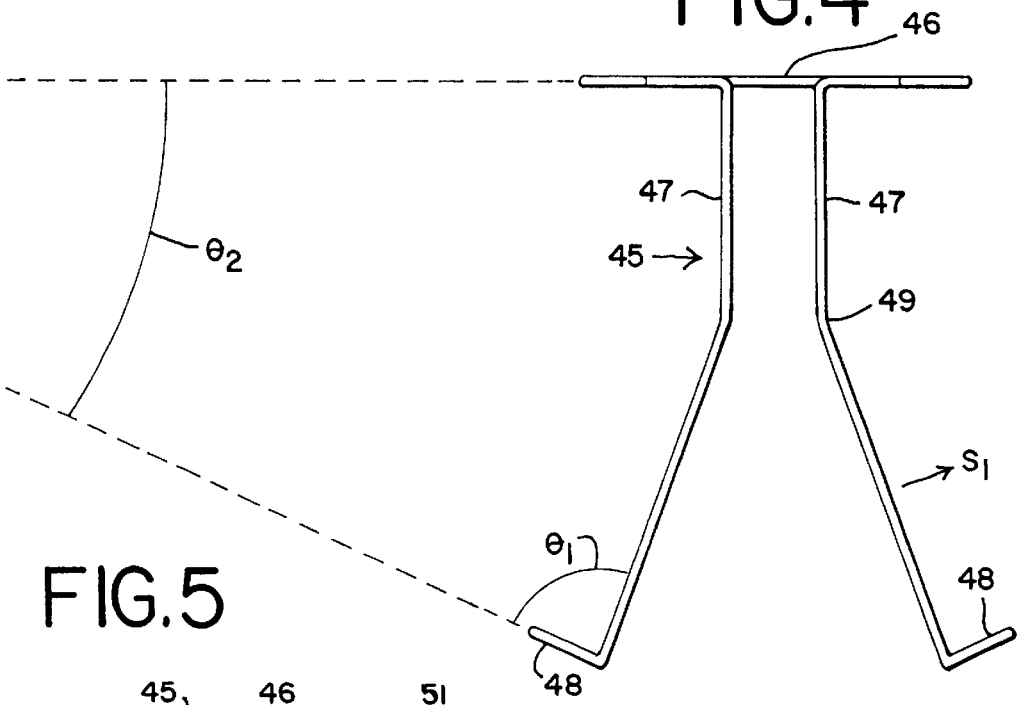
FIG. 4 is an elevational view of the wire form member used in the assembly of FIG. 1.

In one important aspect of the present invention, another member is provided to maintain the handle portions 29 of the containers 22 together. This other member serves as a gripping and connecting member 45 that, as illustrated, may utilize a wire form member that is best depicted in FIG. 4. This member 45 has a flat portion 46 and at least two leg portions 47 extending therefrom in a downward direction. The leg portions 47 define two free ends 48 of the gripping member 45 that engage the container handle portions 29 through holes 29*a* formed therein. As shown, these free ends 48 extend or diverge from the leg portions 47 at an angle $\Theta_1$. They also partially extend along an imaginary line at an angle $\Theta_2$ relative to the gripping member flat portion 46. The leg portions 47 may themselves be bent between the flat portion 46 and the free ends 48 such that the leg portions 47, in the embodiment shown do not necessarily extend along a straight path. This bend 49 adds a measure of flexibility to the gripping member 45 by creating a directed spring force $S_1$ with the leg portions 47, that will, in turn, exert the same force on the supply containers 22 as it does against the band 38.

Figure 5:
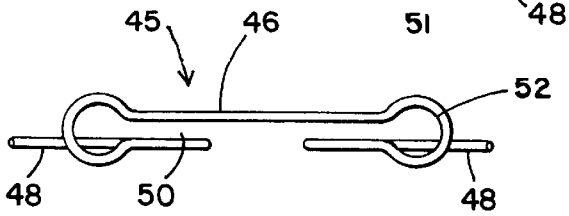
FIG. 5 is a top plan view of the wire form member of FIG. 4.

As shown in FIG. 1, the free ends 48 of the gripping member 45 engage the container flanges 30 at their bottom portions 33, preferably by extending through holes 29*a* formed therein. The wire from which the gripping member 45 is formed is bent into what may be aptly characterized as an open loop 50 (shown in FIG. 5) at the top thereof to form the flat portion 46. It is desirable to form this loop 50 in a common plane so that the flat portion 46 may serve as a handle for the overall assembly. However, as shown in the preferred embodiments, the ends 51 of the loop 50 may themselves include additional loops, or circular openings 52. These openings 52 may receive the ends 53 of a flexible carrying strap 54 that further facilitates the carrying of the two containers 22 by a user.

Figure 6:
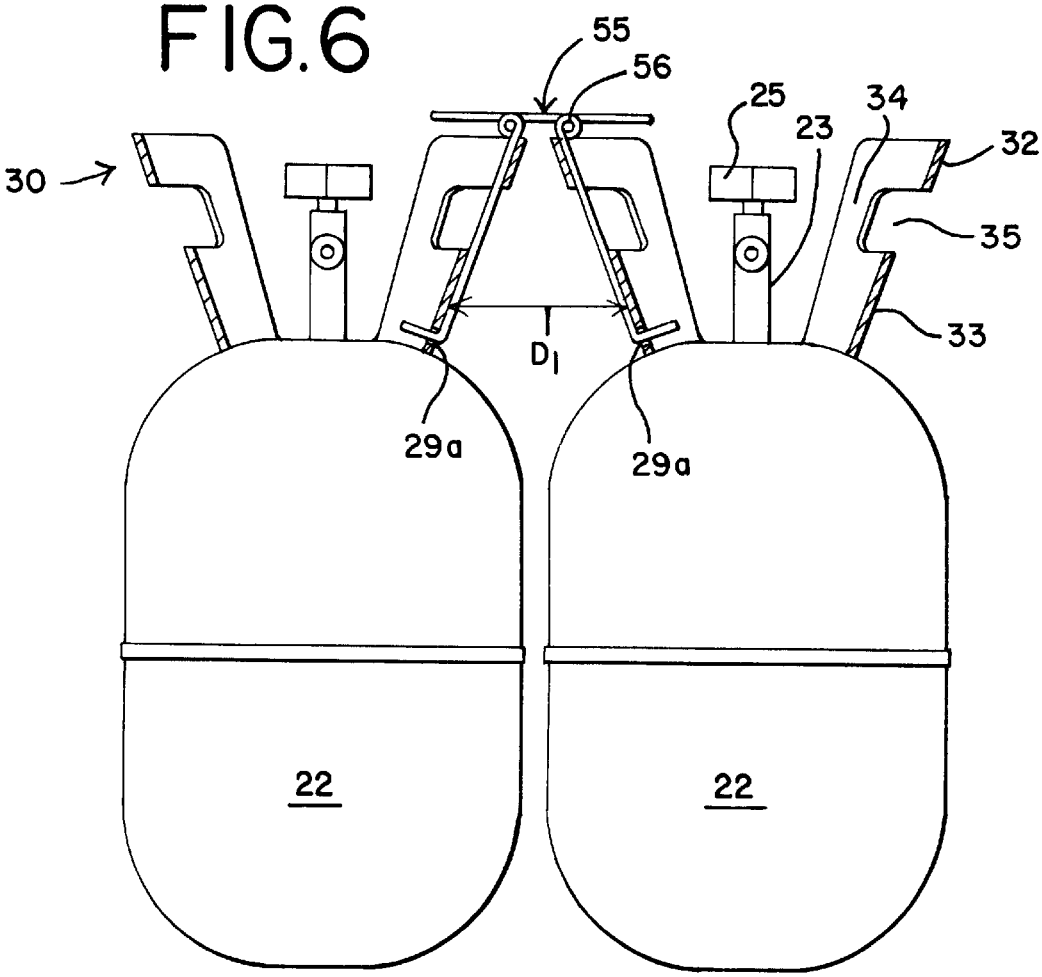
FIG. 6 is a side elevational view of a second embodiment of the wire form installed upon two supply tanks with the outer straps removed.
Figure 7:
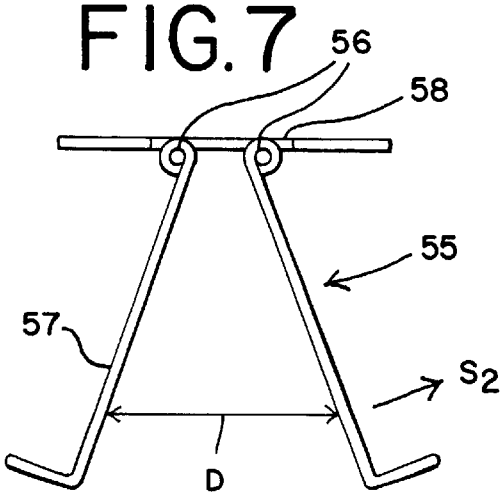
FIG. 7 is a side elevational view of the wire form member of FIG. 6.
Figure 8:
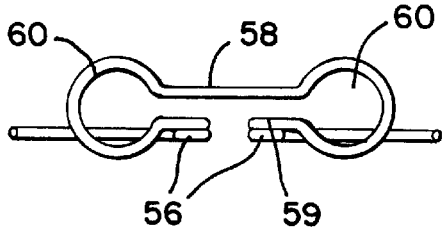
FIG. 8 is a top plan view of the wire form member of FIG. 7.

FIGS. 6–8 illustrate another embodiment of a gripping member 55 used in conjunction with the handle assembly of the invention. In this embodiment, a pair of spring coils 56 are formed as part of the leg portions 57 near the flat portion 58 of the gripping member 55. These spring coils 56 are formed by bending the wire from which the gripping member 55 is formed around and upon itself as illustrated. It can be appreciated that these spring coils 56 are wound in a clockwise direction so as to provide an opposing spring force $S_2$ to the leg portions 57 as shown in FIG. 7. Again, this spring force will tend to urge the container flanges 30 and the containers 22 outwardly against the binding strap 38 and hence, will be characterized in this description as an "outward" spring force. The leg portions of this gripping member 55 may be intertwined into place on the container handles 30, with the leg portions 57 extending inside of the top portion 32 of the flanges through the opening 34 and outside of the bottom portion 33, as shown in FIG. 6.

This gripping member 55 also has an open loop 59 formed along its flat portion 58 that terminates in two smaller loops 60. (FIG. 8) These smaller loops 60 are provided to receive the ends 53 of a handle strap 54. As mentioned previously, the spring coils 56 provide a spring force to the leg portions 57 so that when they are pushed toward each other, an inherent opposing spring force $S_2$ urges the leg portions 57 outwardly. In this regard, the distance D between the leg portions 57 (FIG. 7) is preferably greater than the final distance $D_1$ between the two supply containers handle portions 29 (FIG. 1) when they are brought together and encircled the band 38. As intimated earlier, a unique force arrangement is presented with the present invention. The band 38 draws the containers 22 toward each other, while the gripping member, through its leg portions, tends to urge the containers against band 38, to ensure that the overall assembly acts as a single unit.

Figure 9:
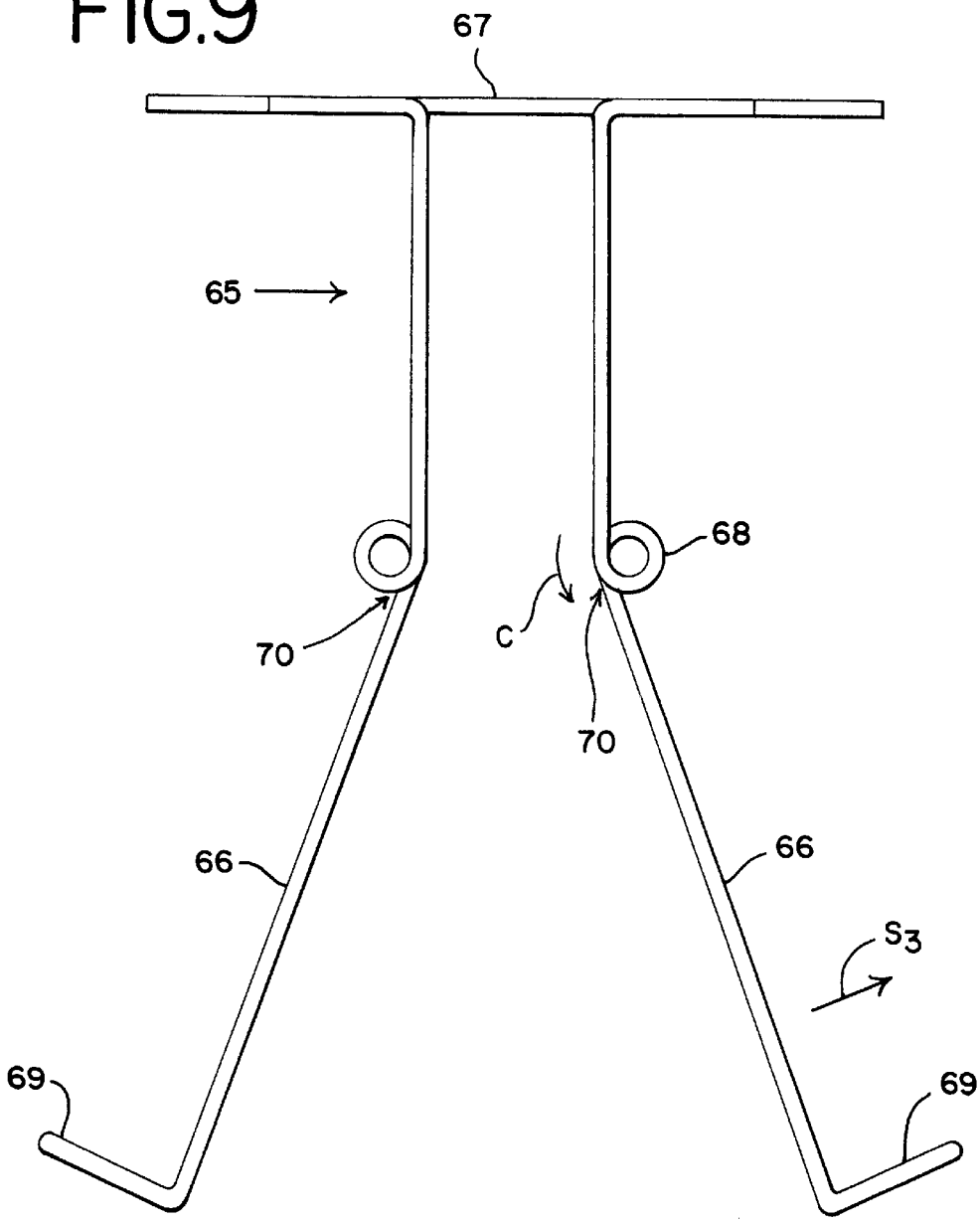
FIG. 9 is a side elevational view of a third embodiment of a wire form member used in the assembly of FIG. 1.
Figure 10:
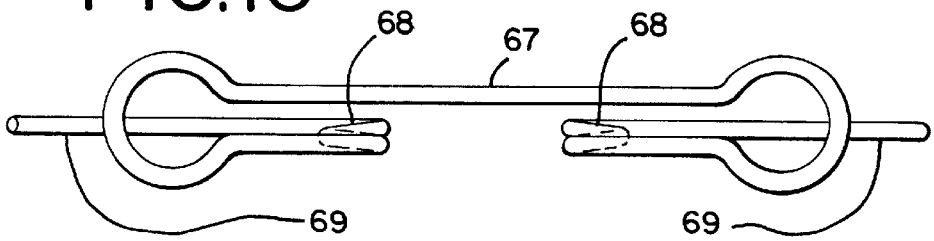
FIG. 10 is a top plan view of the wire form member of FIG. 9.
Figure 11:
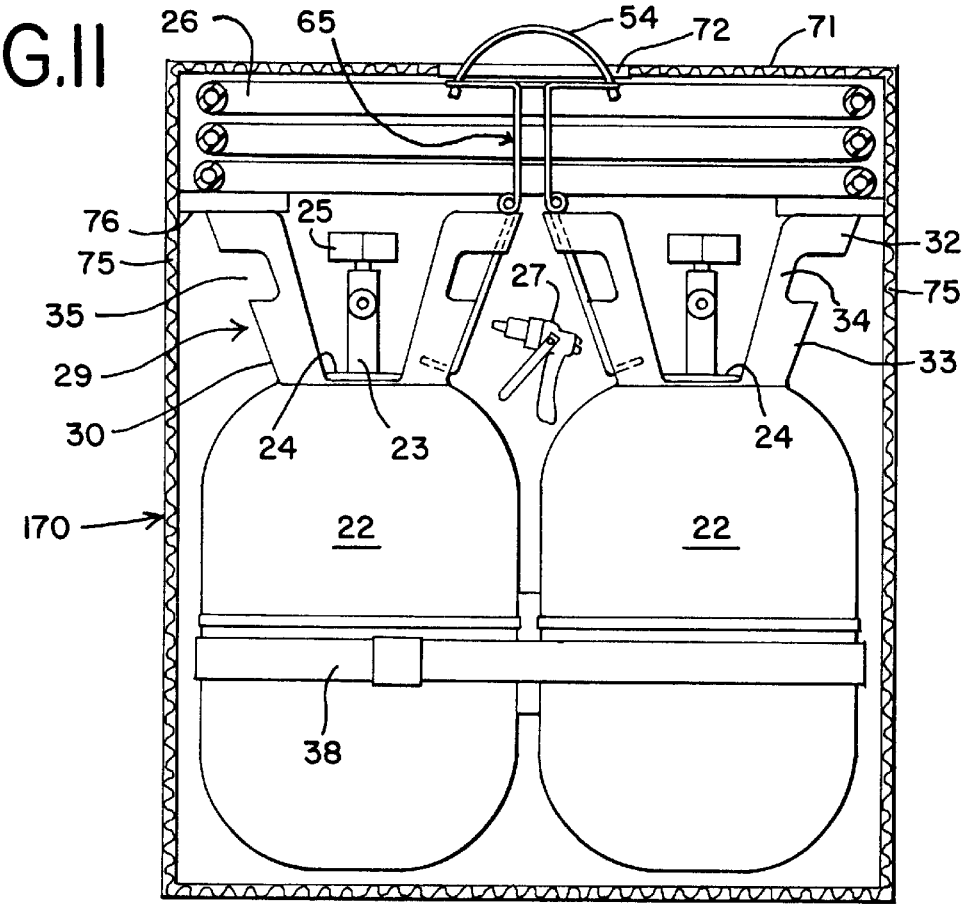
FIG. 11 is a sectional view of a supply tank assembly using the wire form member of FIG. 9 shown stored as an entire assembly within a packaging box.

FIGS. 9–11 illustrate yet another embodiment of a gripping member 65 having leg portions 66 extending down from a flat portion 67. In this embodiment, spring coils 68 are formed in the body of the leg portions 66, between the free ends and the flat portion 67. They are also located at a bend 70 in the leg portions 66 and are wound in a counter clockwise fashion. Not only do the spring coils 68 add an outward spring force $S_3$ to their gripping members, but they also provide a measure of flexibility of attachment to the free end portions 69 so that the leg portions 66 may be manipulated to engage the holes in the container flanges 30 where the engagement holes may have been formed at different locations thereon. The handle, or flat portion 67 is also formed as an open loop like the aforementioned embodiments.

The spring coils or the bends in the gripping member leg portions provide the desired spring force required by the gripping member to exert an opposing force on the supply containers 22 that the band 38 may resist to keep the containers banded together and to reduce the likelihood the containers 22 will work themselves loose. The intervening pad 39 is optional and may be provided not only to serve as a cushion between the containers 22, but also to slightly urge the containers outwardly along their body portions against the band 38, or in other words, to serve as a compressible member that can be compressed by the containers 22 under the influence of the band 38, when it is tightened.

Figure 12:
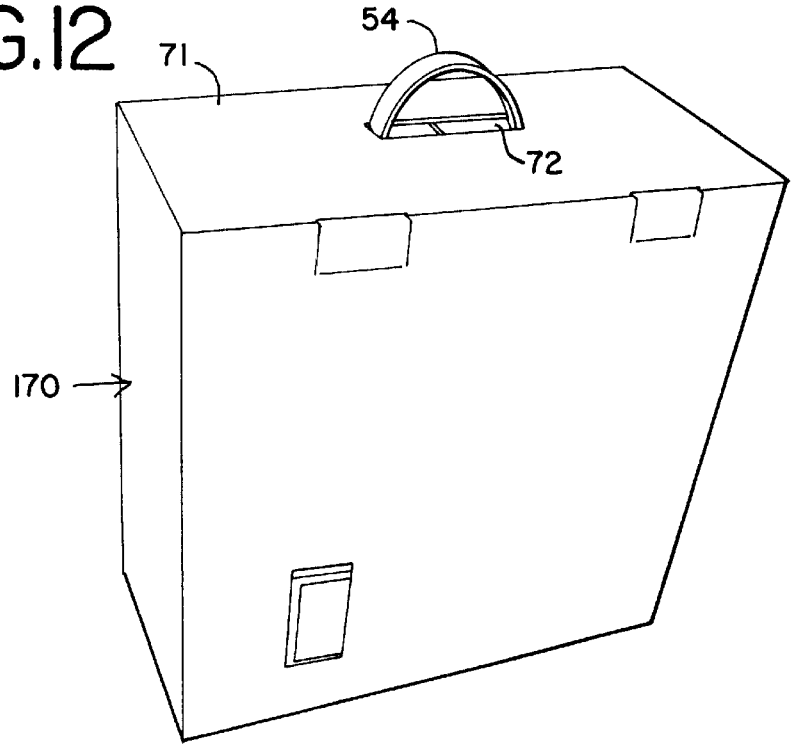
FIG. 12 is a perspective view illustrating how the assembly of FIG. 11 is carried by a user.

As mentioned above, the assembly 20 may include an additional handle member 54 that engages the gripping members to facilitate carrying of the assembly 20. (FIG. 2) This handle 54 also may serve as a handle when the entire unit is packaged such as within the carton 170 of FIGS. 11 and 12. In this regard, the top panel 71 of the carton 170 may be folded to serve as an end flap and may have a slot 72 through which the handle 54 may extend. This carton 170 may also include side slots 75 that are formed by bendable tab portions 76 that may be folded in an up position. In this position, the two tabs 76 will serve to retain the foam supply component hoses 26 in place. The rest of the components may be held within the interior of the carton.

Figure 14:
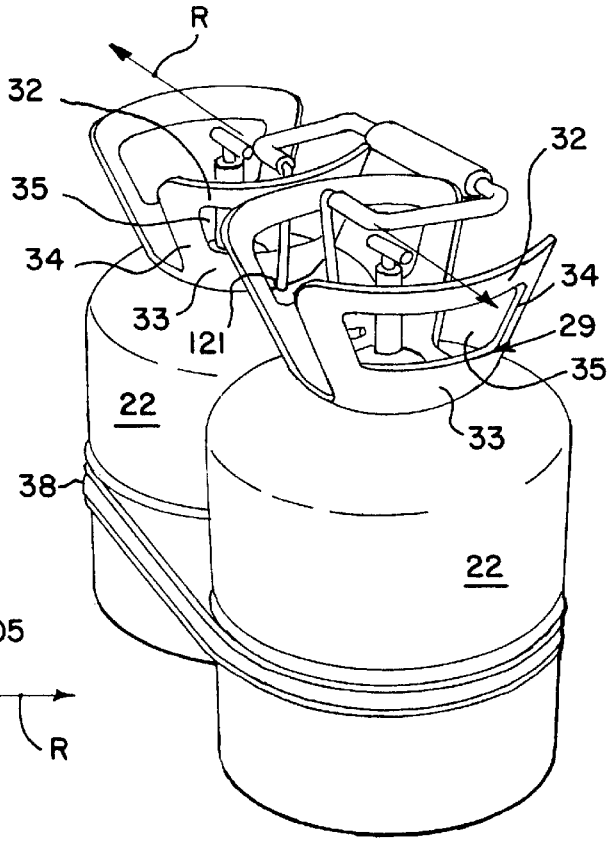
FIG. 14 is a perspective view of a the handle of FIG. 13 in place on a pair of fluid supply containers and folded into a down position; and, FIG. 15 is an enlarged detail view of the handle of FIG. 13 in place on a pair of fluid supply containers.
Figure 13:
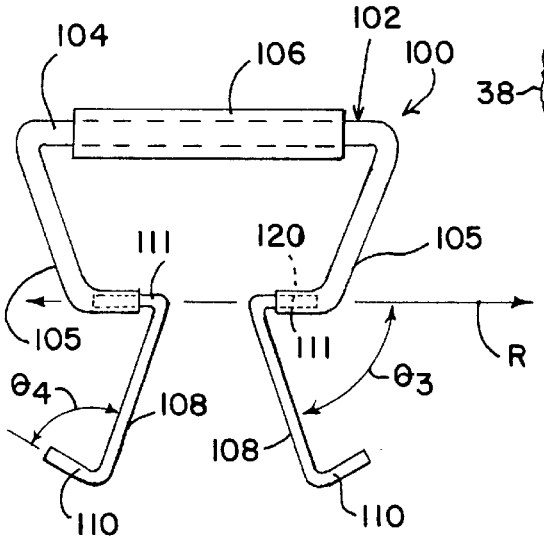
FIG. 13 is an elevational view of another embodiment of a handle assembly constructed in accordance with the principles of the present invention.

Still another embodiment of a handle assembly constructed in accordance with the principles of the present invention is shown generally at 100 in FIG. 13. This embodiment differs from the previous embodiments in that the gripping member 102 has a rotatable flat portion that may be rotated about a centerline R of the pair of supply containers 22 so that it may lie substantially flat to facilitate packing of the overall assembly into cartons as shown in FIG. 14 as well to facilitate stacking of the cartons upon each other with greater stability. In order to accomplish this, the handle assembly 100 preferably is assembled from a plurality of individual components.

As illustrated in FIG. 13, the handle assembly 100 includes a gripping member 102 having a general "U" or "C" shape, with a backbone portion 104 extending between two free end portions 105. Preferably, the free end portions 105 extend inwardly towards each other and are aligned with each other as illustrated. A resilient cover member 106 may be applied to the gripping member backbone portion 104 to facilitate gripping by a user.

In order to effect the rotating nature of the handle 102, the handle assembly 100 includes a pair of leg members 108, each of which also may be aptly characterized as having an overall U- or C-shape. Each leg portion 108 has two free ends 110, 111, each of which is bent at angles $\Theta_3$, $\Theta_4$. Angle $\Theta_4$ is preferably chosen to approximately match the angle at which the supply container flange 29 extends from the supply container 22. Angle $\Theta_3$ is similarly preferably chosen so that the free end 111 of the leg member 108 is oriented level or in a horizontal plane.

Figure 15:
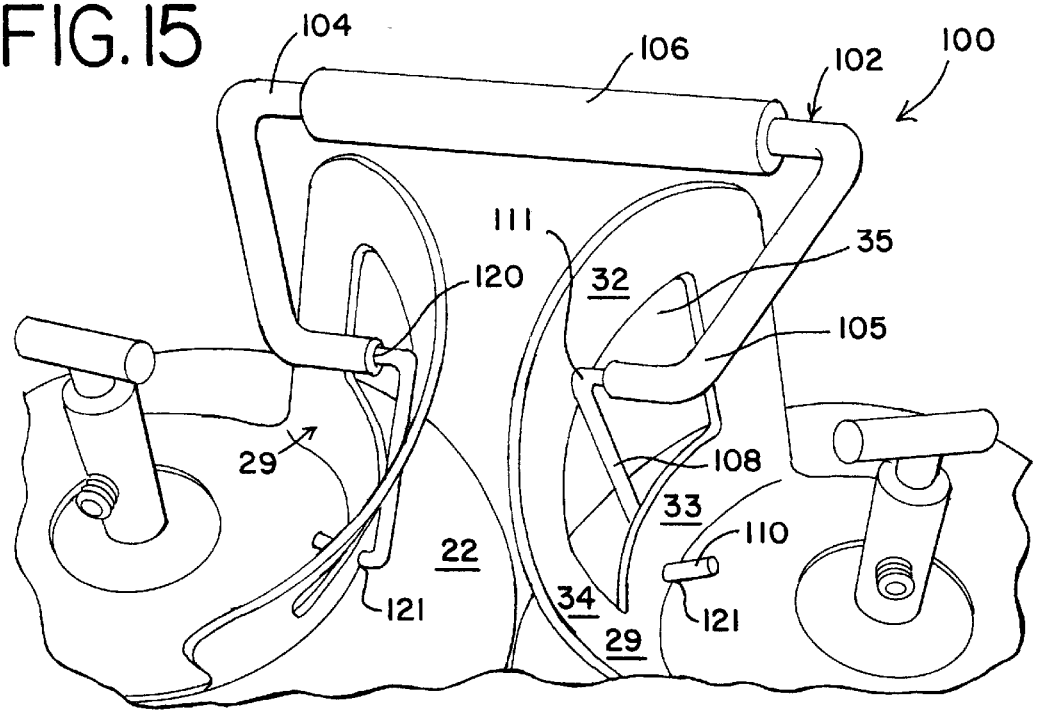

The gripping member 102 is provided with a pair of hollow openings 120 at its free ends which are sized to receive therein, the upper free ends 111 of the two leg members 108 in a manner such that the gripping member 102 is free to rotate when urged by a user. In this regard, the gripping member 102 may be formed from a length of hollow tubing so that the opening 120 therein extends for the length of the gripping member 102. Alternatively, the gripping member 102 may be formed from an extent of solid wire of a given diameter and the end openings 120 thereof may be drilled therein to receive the upper free ends 111 of the two leg members 108. The fit of the leg member free ends 111 in these openings is preferably a frictional fit offering some measure of resistance so that the user may orient the gripping member 102 of the handle assembly to most any desired position, such as the generally vertical orientation illustrated in FIG. 15, the generally horizontal orientation illustrated in FIG. 14, or at various points therebetween. The gripping member 102 also serves to orient the leg members 108 in their preferred angular orientation and thereby provide a spring-like bias to them.

The holes 121 in the flanges 29 receive and hold the leg members 108 in place on the supply containers 22. The leg members 108 are, in essence, "intertwined" through the flange 29 in that their lower ends 110 lie along the outer radial surface of the flange lower part 33, while their upper ends 111 lie against the inner radial surfaces. The leg members 108 are further held in this position by the gripping member 102.

Figure 16:
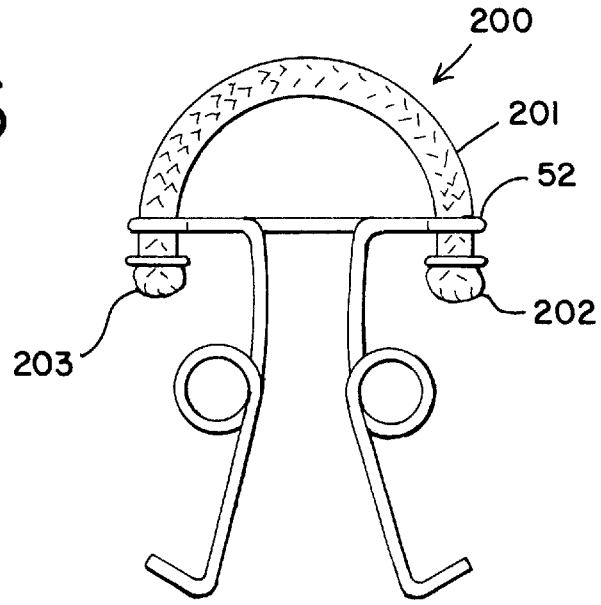
FIG. 16 is an elevational view of a gripping member with an alternate carrying strap.

FIG. 11 illustrates the use of a flexible, plastic carrying strap 54 as a handle portion. Other suitable means may also be used. For example as illustrated in FIG. 16, the carrying strap 200 may include a length of rope 201, the ends 202, 203 of which are threaded through the opening 52 formed in the upper open loop of the gripping member 65. The rope 201 may be moved up and down within the gripping member openings 52 so as to facilitate stacking and/or insertion of the supply tanks into a packaging carton in the manner illustrated in FIG. 11. Both the rope 201 and the carrying strap 200 have length greater than the spacing between the open loop, or slotted ends of the gripping member so that they may bow or have an extent that is spaced away from the gripping member so as to be easily grasped by a user.

Figure 17:
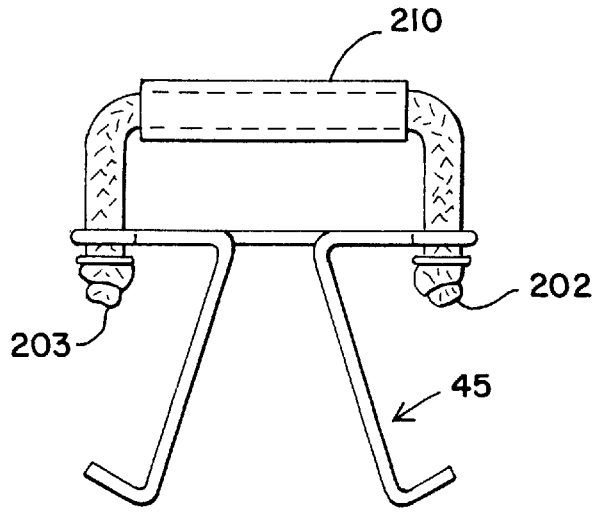
FIG. 17 is an elevational view of another gripping member with a similar carrying strap as in FIG. 16.

The same type of carrying strap 200 may be used with the gripping member 45 illustrated in FIG. 17. In this application, the rope 201 is inserted through the upper openings of the griping member 45 and the rope 201 may have its ends 202, 203 knotted to prevent the pull out of the rope from the gripping member 45. A cover member in the form of a hollow sleeve 210 may be placed over the rope 201 to provide a defined gripping surface thereto.

Figure 18:
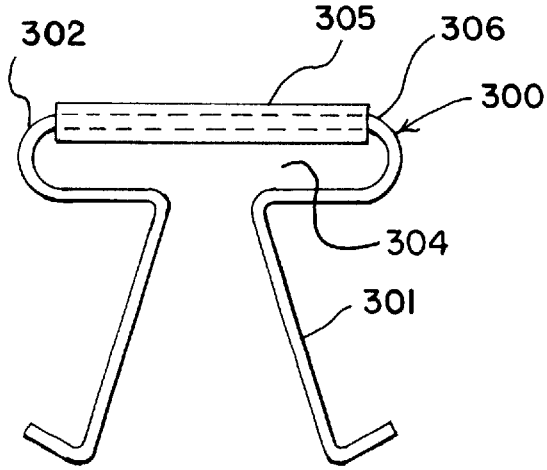
FIG. 18 is an elevational view of another gripping member used with the present invention.

Similarly, as illustrated in FIG. 18, a gripping member 300 may be provided that has its leg portions 301 formed integrally with a handle portion 302 that is spaced apart from the leg portions 301 to define a space 304 into which a user can insert a hand in order to carry the entire assembly. A resilient cover, or sleeve 305, may be formed on the upper flat or backbone portion 306 of the gripping member 300.

Figure 19:
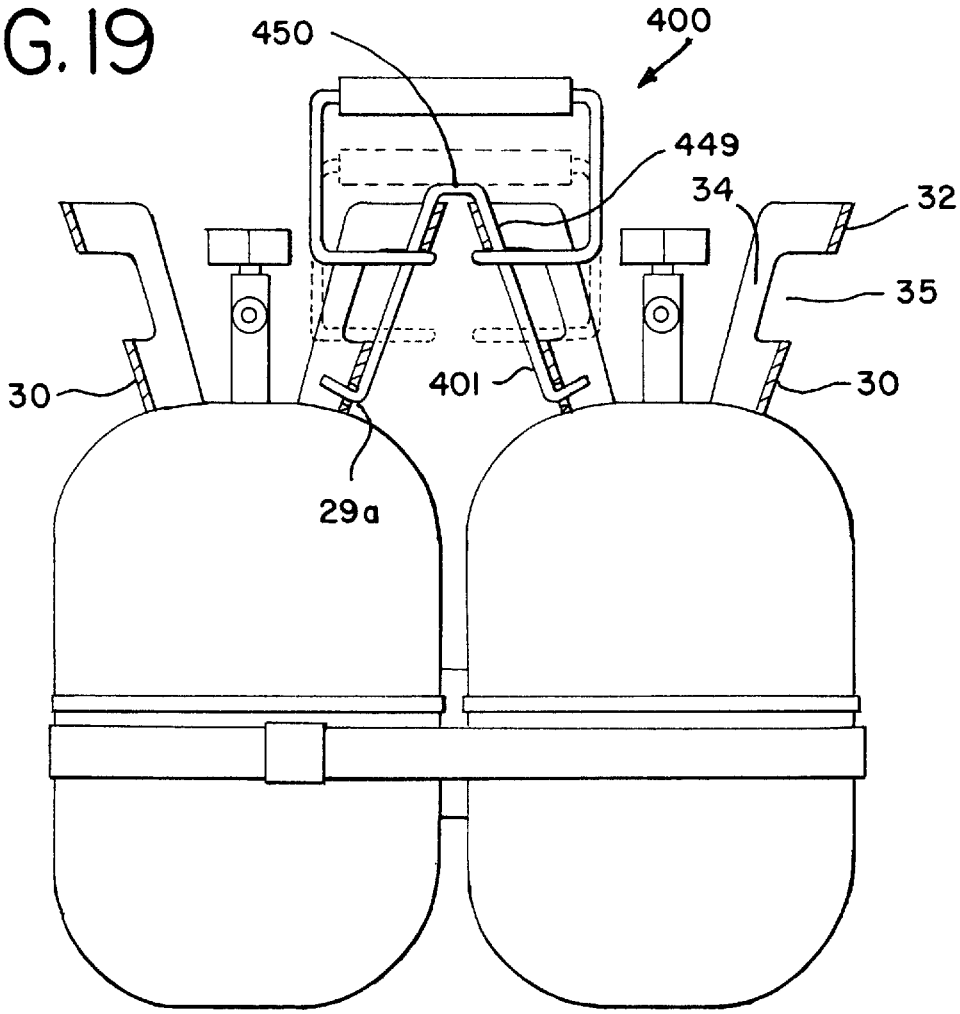
FIG. 19 is an elevational view of an alternate embodiment of a carrying assembly constructed in accordance with the principles of the present invention.
Figure 20:
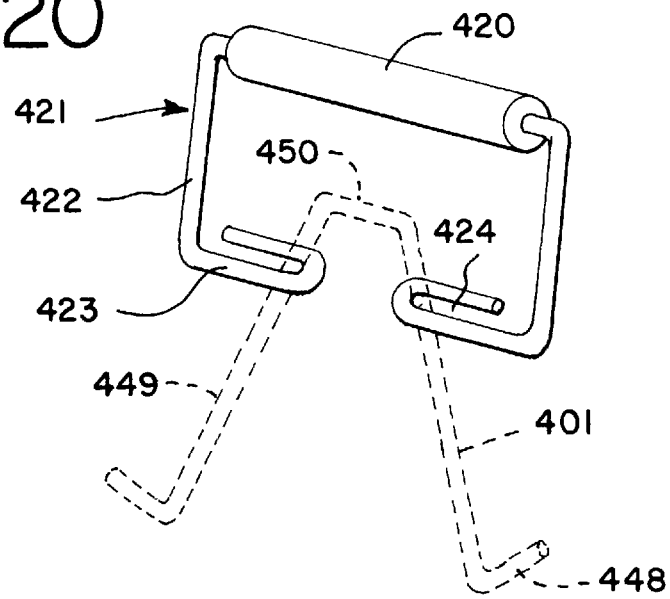
FIG. 20 is a perspective view of one of the components of the carrying assembly of FIG. 19.

FIG. 19 illustrates another embodiment of a carrier assembly 400 constructed in accordance with the principles of the present invention. In this embodiment, the gripping member 401 has a generally inverted V-shape with the free ends 448 engaging openings 29*a* formed in the bottom part of the supply tank flanges 30. The legs 449 of the gripping member are intertwined between the top and bottom portions of the flanges 30. The legs 449 are interconnected together at 450 at a level that is just above the tops of the flanges 30 and which is centered between the free ends 448 so that the legs 449 rise up at an angle. In order to facilitate carrying of the overall assembly, a handle 420 may be provided that is formed from a C-shaped extent of wire 421 having arm portions 422 that terminate in open loop ends 423. These open loop ends 423 have slots 424 that permit the open loop ends 423 to be slid around the gripping member legs 449 as illustrated best in FIG. 20. By virtue of this slotted engagement, the handle 420 may be slid up and down on the gripping member 401 between the positions shown in solid and dashed lines of FIG. 19. In its down position, the handle 420 extends flat across the flanges 30 of the supply tanks. The upward movement of the handle 420 is limited by interference with the inner edges of the top portions 32 of the flanges, and the extent of the handle arms 422, 423 through the flange major openings 34.

Figure 21:
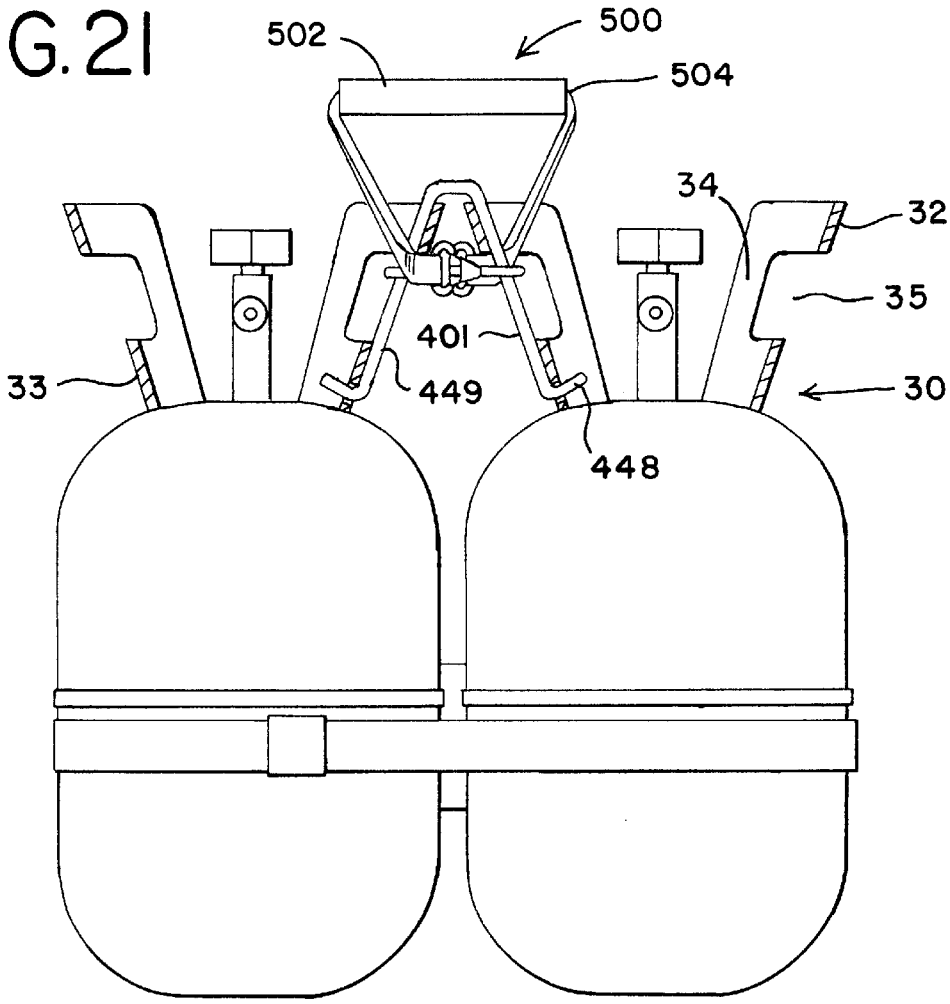
FIG. 21 is an elevational view of a variation of the carrying assembly of FIG. 19; and, FIG. 22 is a top plan view of one of the components of the carrying assembly of FIG. 21.
Figure 22:
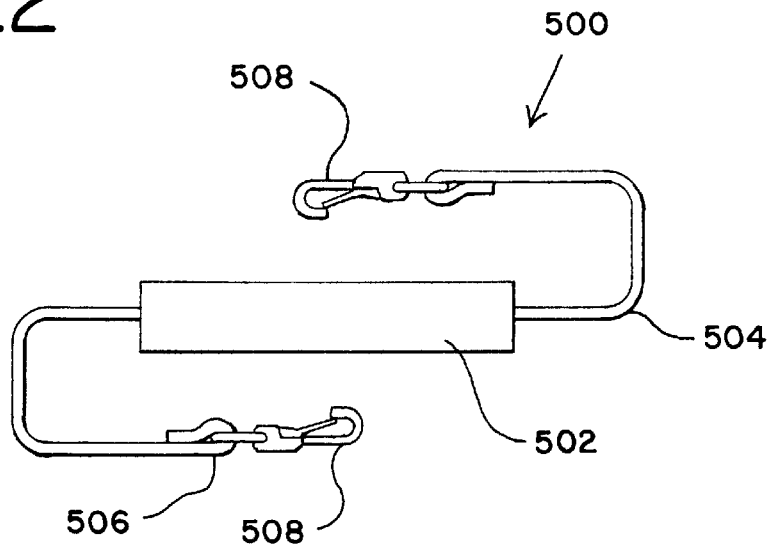

FIGS. 21–22 illustrate a similar embodiment to that in FIG. 19. In this embodiment, the gripping member 401 is essentially the same, but the carrying strap differs. FIG. 22 illustrates a strap 500 with a center gripping sleeve 502 positioned over a durable cloth strap 504. The strap 500 has a pair of free ends 506 that terminate in engagement means, illustrated as clips members 508. The free ends 506 of the strap 500 are run through the flange openings 34 and the clip members 508 are clipped to the legs 449 of the gripping member 401 located opposite the flange opening through while the strap extends. The free ends also are run on opposite sides of the legs 449. In this manner the clips 508 permit the strap 500 to slide up and down the gripping member legs 449. As with the other embodiment the top flange portion 32 limits the upward travel of the clips on the gripping member legs 449.

While the preferred embodiments of the invention have been shown and described, it will be apparent to those skilled in the art that changes and modifications may be made therein without departing from the spirit of the invention, the scope of which is defined by the appended claims. For example, the structure of the gripping member may change as well as the spring coils or bends to apply the desired outward spring force that will at least apply a slight bias to the fluid containers against their outer band.

We claim:

1. An assembly for holding at least two fluid containers in substantially fixed position relative to one another to facilitate the transport or carrying of the containers, each of said containers having a body portion, a flange portion and a neck portion, the assembly comprising:

a band for engaging and holding the body portions of said containers together, the band having an elongated body portion sufficiently great to wrap around said container body portions, said band further having a gripping portion for engaging said band body portion in a manner so as to apply tension to said band to maintain said band in place on said container body portions; and, a handle member for engaging the neck portions of said containers together, the handle member having a flat portion which may be gripped by a user and at least two leg portions extending away from the flat portion, each of the leg portions having a, free end for engaging part of a container neck portion, said handle member leg portions extending from said flat portion at a preselected angle, the leg portions being separated by a distance at free end portions thereof that is greater than a distance between flange portions of said containers to thereby exert a biasing force on said containers to force them against said band.

2. The assembly as set forth in claim 1, wherein said band includes a flexible cable tie.

3. The assembly as set forth in claim 2, wherein said handle member is formed from a length of wire and said container neck portions include holes formed therein, said free ends diverging from said handle member leg portions so as to engage said container neck portion holes.

4. The assembly as set forth in claim 1, wherein said band includes a strap and locking member.

5. The assembly as set forth in claim 1, wherein said band includes a plastic strap.

6. The assembly as set forth in claim 1, wherein said handle member is a continuous wire form member and said free ends diverge outwardly from said handle member leg portions.

7. The assembly as set forth in claim 6, wherein said leg portions include a bend intermediate of said handle member and free end portions.

8. The assembly as set forth in claim 1, further including a spacer member for interposing between said containers.

9. The assembly as set forth in claim 8, wherein said spacer member is formed from a compressible material.

10. The assembly as set forth in claim 1, wherein said handle member flat portion movably engages said handle member leg portions such that said flat portion may be moved from side to side of a common centerline of said fluid containers and said handle member flat portion has a straight backbone portion extending between two free ends, each of the free ends having an opening disposed therein that receives a corresponding opposing free end of one of said handle member leg potion.

11. The assembly as set forth in claim 10, wherein said handle member flat portion is capable of laying flat upon said fluid container neck portions.

12. The assembly as set forth in claim 10, wherein each said handle member flat portion free ends frictionally engages one of said handle member leg portion free ends.

13. The assembly as set forth in claim 1, wherein said handle member includes a resilient outer covering extending along said flat portion.

14. The assembly as set forth in claim 1, wherein said handle member has an inverted V-shape and further includes a generally C-shaped handle member having free ends, each of the free ends engaging one of said handle member leg portions.

15. The assembly as set forth in claim 14, wherein each of said C-shaped handle member free ends includes a slot, said slots receiving said leg portions therein.

16. The assembly as set forth in claim 14, wherein said C-shaped handle member includes a wire form member.

17. The assembly as set forth in claim 1, wherein said handle member has an inverted general V-shape and includes a flexible carrier strap having two free ends, each of said carrier strap free ends engaging a corresponding handle member leg portion.

18. A gripping member for holding two fluid containers together and for providing a means to grasp the two containers as a unit comprising:

a gripping portion having a length sufficient for grasping by a user's hand, a pair of leg portions for engaging portions of the two containers, the leg portions having first free ends that extend away therefrom, said first free ends being spaced apart from each other a first distance so as to maintain a second distance between said two containers, wherein said gripping portion rotatably engages said leg portions.

19. The gripping member of claim 18, wherein said leg portions extend downwardly with respect to said gripping portion in a divergent fashion such that a distance separating said leg portions varies along the length of said leg portions.

20. The gripping member of claim 18, wherein said leg portions each include respective bends disposed therein between said gripping portion and said free ends, said bends defining separate first and second parts of each of said leg portions, said leg portion first parts depending downwardly from said gripping portion and generally perpendicular with respect to said gripping portion and each of said leg portion second parts extending at an angle with respect to its associated leg portion first part.

21. The gripping member of claim 20, wherein said gripping member and said leg portions are separate pieces, said gripping member having two free ends with openings disposed therein, said leg portions having second free ends that are each received within one of said gripping member free end openings.

22. The gripping member of claim 21, wherein said leg portion second free ends and said gripping member free end openings frictionally engage each other.

23. A kit of parts for providing a carrier assembly for a pair of fluid supply containers, each of the containers having a generally cylindrical body portion with an upstanding flange rising therefrom, the kit of parts comprising:

a carrier having a handle portion and a pair of legs extending downwardly therefrom, the legs following a divergent path with respect to each other such that they are separated by an intervening spacing that increases along the lengths of the legs, said legs each having a free end portion that respectively engages parts of said container flanges in a manner such that engaging said leg free end portions to said containers and moving said containers together places said legs under compression and said legs thereby exerting a counteracting spring resistance force against said containers; and, a band member having a length sufficient to extend around both of said fluid supply containers to hold them together as a unit, and to maintain said legs under compression.

24. The kit of parts of claim 23, wherein said band member is an elongated cable tie.

25. The kit of parts of claim 23, wherein said legs are formed separately from said handle portion and said handle portion is movable with respect to said legs.

26. The kit of parts of claim 25, wherein said legs are formed from a single length of wire and are interconnected together by an interconnecting portion.

27. The kit of parts of claim 26, wherein said legs and interconnecting portions having a general inverted V-shape, and said kit further includes a handle having a backbone interposed between two free ends, each of the free ends slidably engaging one of said legs and each of said handle free ends includes a slot, each of said free end slots receiving one of said legs therein.

28. The kit of parts of claim 27, wherein said handle is a wire form member and includes a grasping sleeve on said backbone.

29. The kit of parts of claim 23, wherein said handle portion includes a generally C-shaped member having a backbone interconnecting two free ends, the handle portion free ends rotatably engaging corresponding opposing free ends of said legs.

30. The kit of parts of claim 23, wherein said handle portion is formed from a hollow metal tube.

31. An assembly for holding at least two fluid containers in substantially fixed position relative to one another to facilitate the transport or carrying of the containers, each of said containers having a body portion, a flange portion and a neck portion, the assembly comprising:

a band for engaging and holding the body portions of said containers together, the band having an elongated body portion sufficiently great to wrap around said container body portions, said band further having a gripping portion for engaging said band body portion in a manner so as to apply tension to said band to maintain said band in place on said container body portions; and, a handle member for engaging the neck portions of said containers together, the handle member having a flat portion which may be gripped by a user and at least two leg portions extending away from the flat portion, each of the leg portions having a free end for engaging part of a container neck portion, said handle member leg portions extending from said flat portion at a preselected angle, the leg portions being separated by a distance at free end portions thereof that is greater than a distance between flange portions of said containers to thereby exert a biasing force on said containers to force them against said band, wherein said handle member flat portion movably engages said handle member leg portions such that said flat portion may be moved from side to side of a common centerline of said fluid containers.

32. The assembly as set forth in claim 31, wherein said handle member flat portion has a straight backbone portion extending between two free ends, each of the free ends having an opening disposed therein that receives a corresponding opposing free end of one of said handle member leg portions.

33. The assembly as set forth in claim 22, wherein each of said handle member flat portion free ends frictionally engages one of said handle member leg portion free ends.

34. The assembly as set forth in claim 31, wherein said handle member flat portion is capable of laying flat upon said fluid container neck portions.

35. A kit of parts for providing a carrier assembly for a pair of fluid supply containers, each of the containers having a generally cylindrical body portion with an upstanding flange rising therefrom, the kit of parts comprising:

a carrier having a handle portion and a pair of legs extending downwardly therefrom, the legs following a divergent path with respect to each other such that they are separated by an intervening spacing that increases along the lengths of the legs, said legs each having a free end portion that respectively engages parts of said container flanges in a manner such that engaging said leg free end portions to said containers and moving said containers together places said legs under compression and said legs thereby exerting a counteracting spring resistance force against said containers; and, a band member having a length sufficient to extend around both of said fluid supply containers to hold them together as a unit, and to maintain said legs under compression, wherein said handle portion includes a generally C-shaped member having a backbone interconnecting two free ends, the handle portion free ends rotatably engaging corresponding opposing free ends of said legs.

36. A kit of parts for providing a carrier assembly for a pair of fluid supply containers, each of the containers having a generally cylindrical body portion with an upstanding flange rising therefrom, the kit of parts comprising:

a carrier having a handle portion and a pair of legs extending downwardly therefrom, the legs following a divergent path with respect to each other such that they are separated by an intervening spacing that increases along the lengths of the legs, said legs each having a free end portion that respectively engages parts of said container flanges in a manner such that engaging said leg free end portions to said containers and moving said containers together places said legs under compression and said legs thereby exerting a counteracting spring resistance force against said containers; and, a band member having a length sufficient to extend around both of said fluid supply containers to hold them together as a unit, and to maintain said legs under compression, wherein said legs are formed separately from said handle portion and said handle portion is movable with respect to said legs, said legs are formed from a single length of wire and are interconnected together by an interconnecting portion, and said legs and interconnecting portions having a general inverted V-shape, and said kit further includes a handle having a backbone interposed between two free ends, each of the free ends slidably engaging one of said legs.

37. The kit of parts of claim 36, wherein each of said handle free ends includes a slot, each of said free end slots receiving one of said leg portions therein.

38. The kit of parts of claim 37, wherein said handle is a wire form member and includes a grasping sleeve on said backbone.

* * * * *